US005152037A

United States Patent [19]

Schiek et al.

[11] Patent Number: 5,152,037

[45] Date of Patent: Oct. 6, 1992

[54] ADJUSTABLE HOOK AND LOOP-TYPE FASTENER ASSEMBLY

[76] Inventors: James M. Schiek, 1031 S. Webster, Omro, Wis. 54963; James W. Schiek, Sr., 513 B. Saratoga Ave., Fond du Lac, Wis. 54935

[21] Appl. No.: 665,980

[22] Filed: Mar. 7, 1991

[51] Int. Cl.[5] ..... A44B 18/00

[52] U.S. Cl. ..... 24/442; 24/306

[58] Field of Search ..... 428/43, 100; 24/306, 24/442, 444; 52/DIG. 13

[56] References Cited

U.S. PATENT DOCUMENTS 4,271,566 6/1981 Perina ..... 52/DIG. 13
4,430,835 2/1984 Ericson ..... 24/306 X
4,710,414 12/1987 Northrup et al. ..... 24/444 X
4,933,035 6/1990 Billarant et al. ..... 24/444
4,946,723 8/1990 Paules et al. ..... 428/43

*Primary Examiner*—James R. Brittian
*Attorney, Agent, or Firm*—Andrus, Sceales, Starke & Sawall

[57] ABSTRACT

A hook and loop-type fastener system is provided with a shield disposed between the mated, juxtaposed hooked and looped surfaces of the fastener to preclude premature and inadvertent engagement. Once the two components of the fasteners have been properly positioned relative to one another, the shield may be removed, thereby facilitating engagement and bonding of the surfaces to one another.

10 Claims, 3 Drawing Sheets

FIG. 1
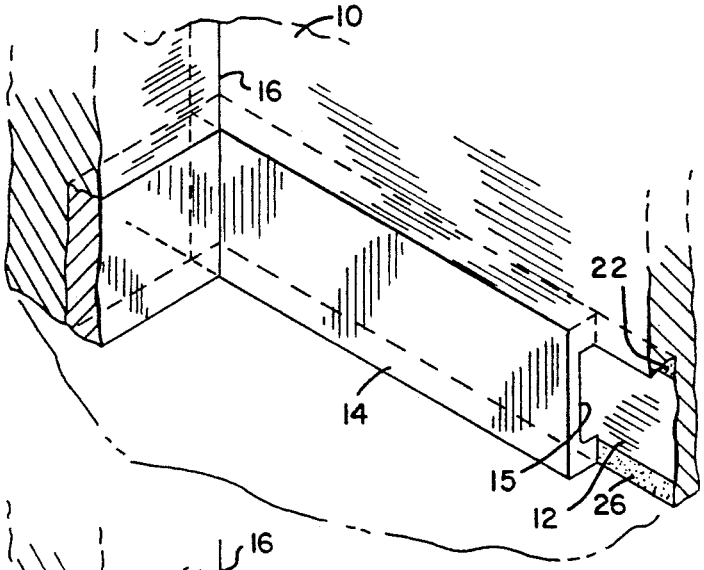
FIG. 2
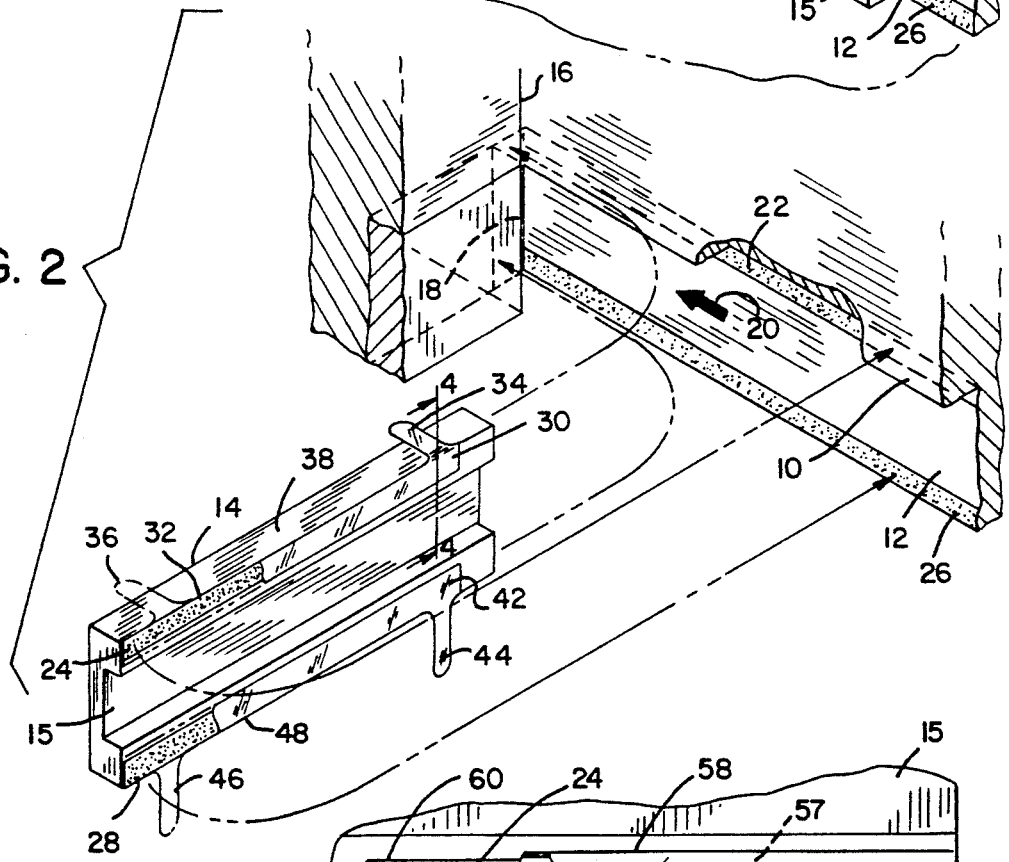
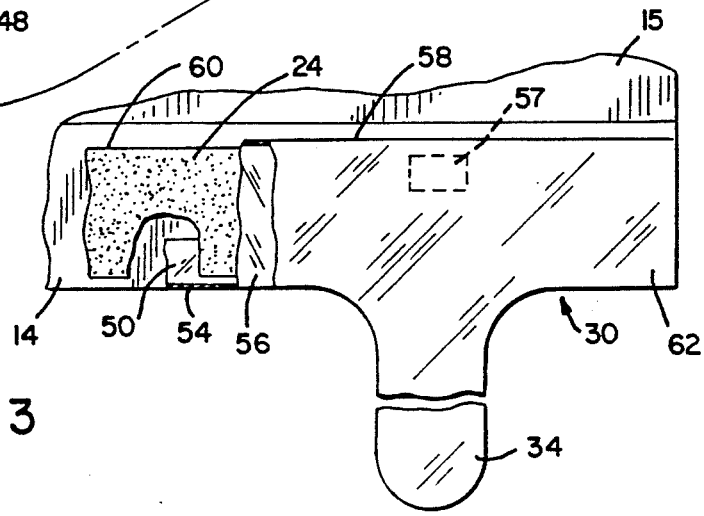
FIG. 3

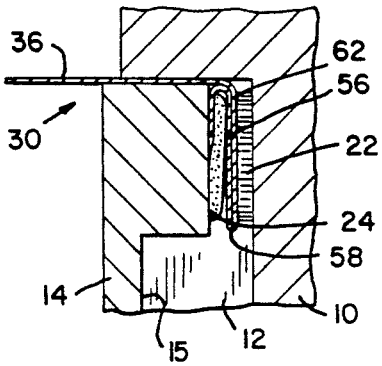
FIG. 4
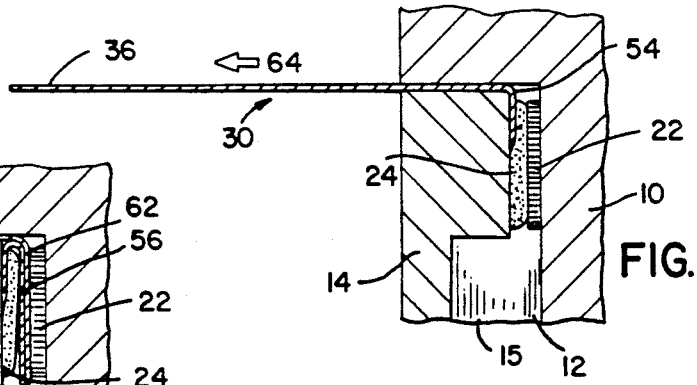
FIG. 5
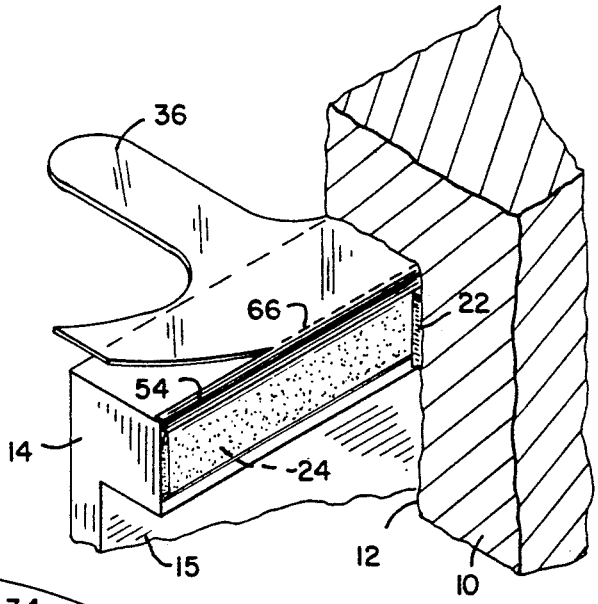
FIG. 6
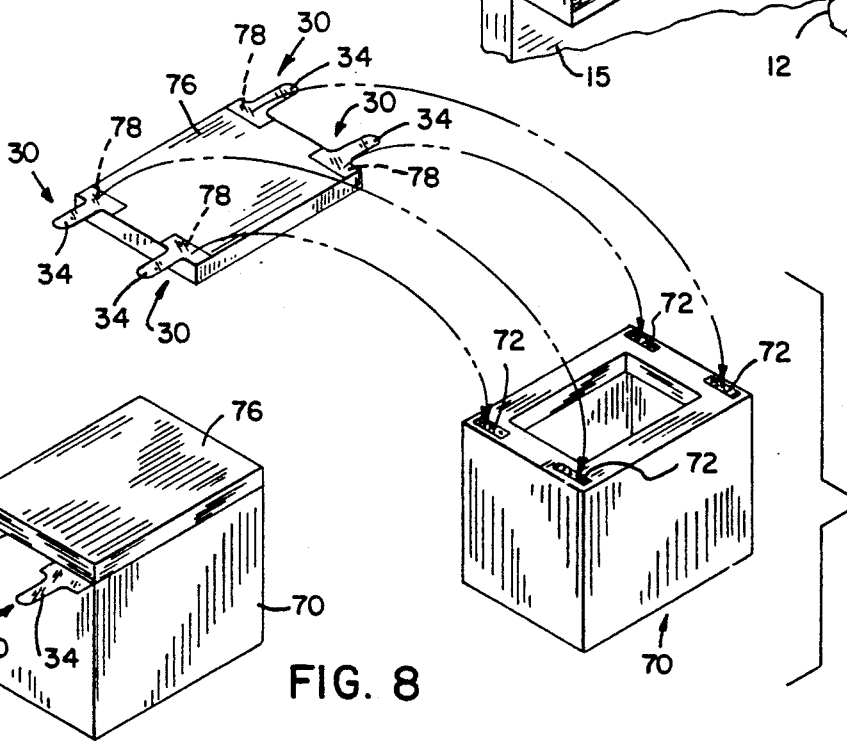
FIG. 7
FIG. 8

FIG. 9
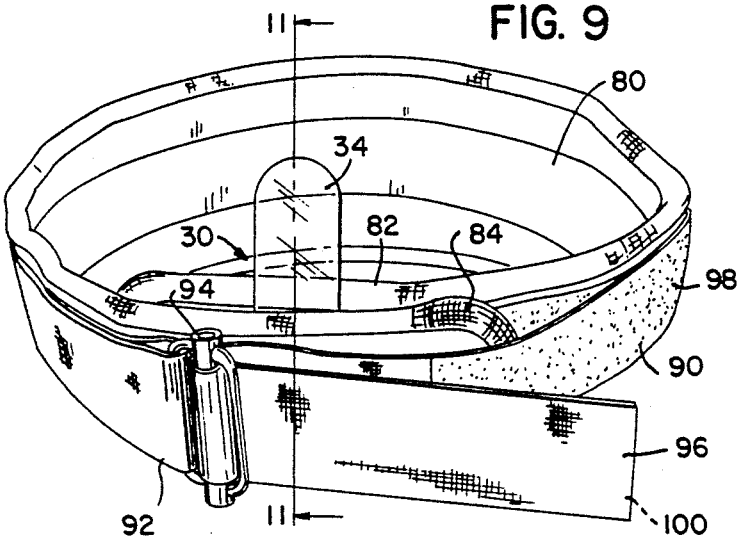
FIG. 11
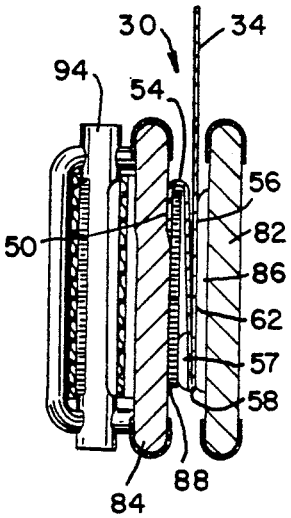
FIG. 12
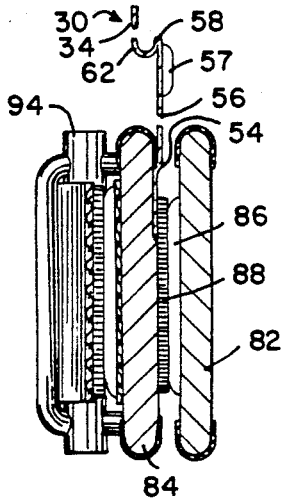
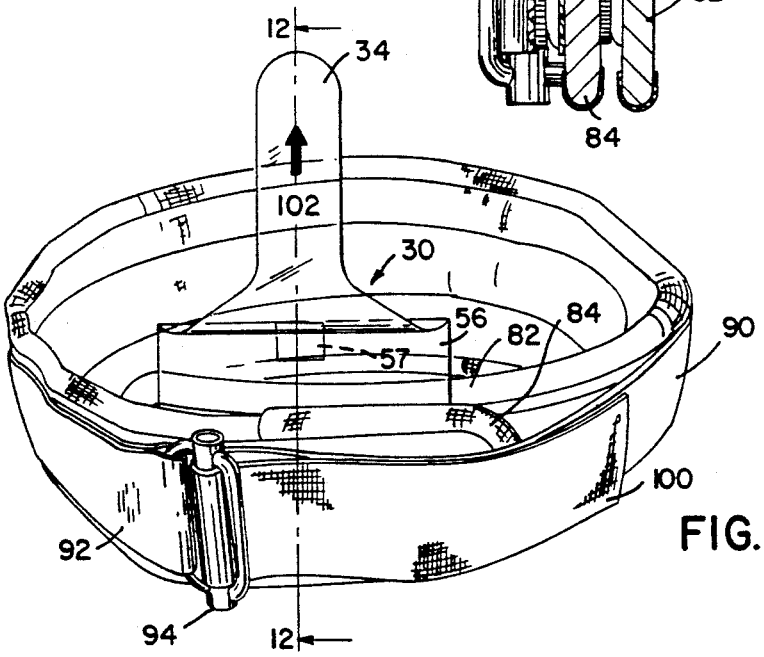
FIG. 10

ADJUSTABLE HOOK AND LOOP-TYPE FASTENER ASSEMBLY

BACKGROUND OF THE INVENTION

1. Field of the Invention

The subject invention is directed generally to hook and loop-type fastener assemblies and is specifically directed to a protective device for insuring against inadvertent premature attachment of the hook and loop fastener components.

2. Description of the Prior Art

This application is related to our co-pending application Ser. No. 07/665,990 entitled "Belt Support Device with Adjustable Hook and Loop-Type Fastener", filed on even date herewith. Hook and loop-type fastener assemblies are well known. The Velcro brand fasteners have been available for many years. Other manufacturers produce products which function in basically the same manner as the Velcro brand hook and loop type fastener. For example, 3M Corporation, Minneapolis, Minnesota, has several fastener systems which operate in the same basic manner as the hook and loop-type fastener. The 3M Dual Lock, the 3M Mushroom Loop, and the 3M Latchlok fastener systems are examples of fasteners which have the same function as the hook and loop-type fastener system originally developed by Velcro. Throughout this application when reference is made to the hook and loop-type fastener system, it is meant to encompass all the variations thereof.

All of these hook and loop-type fastener systems comprise a pair of complementary surfaces, generally available in strip or pad form. One of the strips or pads is provided with a hooked surface, and the mated strip or pad is provided with a looped surface. Once the complementary strips or pads are placed in mated juxtaposition and a light pressure is applied, they form a mechanical bond and provide a strong, semi-permanent closure which may be opened by removing, in sequence, a small portion of the hook and loop bond, preserving the system for reuse.

All of the hook and loop-type fasteners of the prior art have the same disadvantage in that once the two mated hooked and looped surfaces are placed in contact with one another, bonding is initiated. This precludes the adjustment or positioning of the two components which are to be fastened to one another after the components are placed in juxtaposition.

In many applications, it is desirable to reposition the components after they have been placed in juxtaposition, to assure proper placement and accuracy of assembly. In applications such as these, use of the typical hook and loop-type fastening system is impaired, if not rendered totally impractical.

SUMMARY OF THE INVENTION

The subject invention provides for an improved hook and loop-type fastening system, wherein the mated hooked and looped surfaces of the fastening system include a protective shield between the juxtaposed surfaces. The shield precludes inadvertent and premature engagement of the surfaces during storage and use. Once the surfaces are properly positioned relative to one another, the shield may be removed to facilitate attachment of the surfaces to one another.

The shield may be a permanent part of the assembly when reuse is desired. For example, in a tensioning belt or strap, it is desirable that the belt be placed around the object to be strapped and manually tensioned before the fasteners are engaged. By utilizing the reusable shield of the subject invention, the straps may be placed in position and manually tensioned without premature engagement of the fasteners. Once the belt is properly placed in position, the shield may be removed and the juxtaposed mated fasteners will engage. When the fasteners are loosened and the belt or strap is removed from the object, the shield may be replaced over one of the surfaces to permit ready reuse.

The shield may also be detachable from the assembly, where permanent attachment is desired. For example, hook and loop-type fasteners cannot presently be used in permanent assemblies where two rigid members are to be secured to one another because of the impossibility of moving the members once face contact has been made. This is particularly true since the hook and loop-type fasteners must be sequentially disengaged and the rigid assembly precludes this. By using the removable, detachable shield of the subject invention, the two members may be placed in position with the mated hooked and looped surfaces in juxtaposition, without engagement. This permits the two members to be accurately repositioned relative to one another before the fastener system is engaged. When the members are properly positioned, the shield is removed and detached from the assembly and the hook and loop fastener system is operative to substantially secure the members to one another.

It is, therefore, an object and feature of the subject invention to provide for an improved hook and loop-type fastener system, permitting repositioning of the components to be secured to one another after the hooked and looped surfaces have been placed in mated juxtaposition.

It is another object and feature of the invention to provide for a protective shield to be used in conjunction with a hook and loop-type fastener system for precluding inadvertent and premature engagement of the hooked and looped surfaces of the fasteners.

It is yet another object and feature of the subject invention to provide for an improved hook and loop-type fastener system which is adaptable for substantially bonding rigid members to one another, while permitting repositioning and accurate alignment of the members after the hooked and looped surfaces of the fastener system have been placed in mated juxtaposition.

Other objects and features of the subject invention will be readily apparent from the accompanying drawing and detailed description of the preferred embodiments.

BRIEF DESCRIPTION OF THE DRAWING

FIG. 1 is a perspective view of an assembly including two rigid members utilizing the improved fastener system of the subject invention.

FIG. 2 is a perspective view similar to FIG. 1 showing one of the rigid members prior to attachment.

FIG. 3 is an enlarged fragmentary plan view, showing the improved fastener system of the subject invention.

FIG. 4 is a section view looking generally in the direction of arrows 4—4 of FIG. 2, shown after the rigid members have been assembled.

FIG. 5 is a view similar to FIG. 4, after the tab has been removed and the fastening system has been engaged to bond the two members to one another.

FIG. 6 is a fragmentary perspective view of the assembly shown in FIG. 1.

FIG. 7 is a perspective view of an alternative embodiment of the invention.

FIG. 8 is a view of the embodiment of FIG. 7, after the fastener system has been engaged.

FIG. 9 is a perspective view of another embodiment of the invention.

FIG. 10 is a perspective view of the embodiment shown in FIG. 9, after the fastening means has been engaged.

FIG. 11 is a section view taken generally in the direction of arrows 11 in FIG. 9.

FIG. 12 is a section view taken generally in the direction of arrows 12 in FIG. 10.

DETAILED DESCRIPTION OF THE PREFERRED EMBODIMENTS

The improved hook and loop-type fastener system of the subject invention is shown as used in conjunction with a rigid assembly in FIGS. 1-6. Such an assembly is often used for portable walls for office partitions and the like. As there shown, a first vertical wall section 10 includes a recessed channel 12 which often is adapted for enclosing or containing communications cable, electrical wiring and the like in a flush panel 14 having an integral trough 15, or the like. The panel 14 is adapted to be permanently secured to the upright wall section 10 to close the recessed channel 12 and preclude unauthorized entry and/or tampering. When both the sections 10 and 14 are made of a rigid material, the use of hook and loop-type fasteners has been substantially precluded. This is particularly true, when as shown in FIG. 1, the wall section includes an inside corner 16 resulting in a recessed channel portion 18 which is closed on four of its six sides. When this occurs, it is required that the cover 14 be placed in channel 12 and moved in the direction of arrow 20, rendering it impractical to use hook and loop-type fasteners which become engaged immediately upon contact.

The present invention provides for an improved fastener which will permit the use of hook and loop-type fasteners in such applications. As shown, a first strip 22 of the hook and loop-type fastener system is secured to and extends along the inner longitudinal edge of the channel 12. The mated strip 24 of the fastener system is secured to the complementary edge cf the cover panel 14. A like pair of strips 26, 28 are secured to the opposite edges of the channel 12 and the panel 14.

In the preferred embodiment of the subject invention, a flexible shield 30 is secured to the upper longitudinal edge 32 of the cover panel 14 and spans and covers the fastener strip 24. A pair of integral elongate tabs 34, 36 are secured to shield 30 and extend outwardly therefrom and over and outwardly from the upper surface 38 of the cover panel 14. A like shield 42 with tabs 44, 46 is placed over and covers the fastener strip 28 along the lower edge 48 of the cover panel.

With specific reference to FIG. 3, the preferred embodiment of the assembly comprises a shield member 30 which has an elongate strip 50 secured directly to the surface of the panel 14. The shield is made of a foldable, durable material such as, by way of example, vinyl. The strip 24 is then secured by suitable means over the strip 50 of the shield 30 and onto panel 14. Adjacent the one longitudinal edge 52 of the strip 24 is a first fold line 54 of the shield 30. This permits the shield to be folded back over the strip 24, spanning the entire surface of the strip with the shield layer 56. A second fold 58 is provided adjacent the opposite edge 60 of the strip. The second fold defines the flap surface 62 of the shield which terminates in the elongate extension tab 36. In the preferred embodiment, the shield layer includes a patch 57 which is a complementary fastener component compatible with the fastener surface of strip 24. This temporarily holds the shield in place during assembly.

As shown in FIG. 4, when the panel 14 is placed in the channel 12, the mated surfaces 22, 24 are placed in juxtaposition with one another. The shield 30 precludes engagement and premature attachment of the hooked and looped surfaces. Once the panel 14 has been properly positioned relative to panel 10, tab 34 may be pulled in the direction of arrow 64 (see FIG. 5), pulling the shield 30 away from the surface of strip 24, permitting the hooked and looped surfaces to engage and bond.

With reference to FIG. 6, a separation line 66 may be provided adjacent the fold line 54 of the shield 30. This permits the shield 30 to be permanently removed from the assembly after the panel 14 is secured to the wall 10 in the desired manner, thereby providing a permanent bonded assembly system utilizing the hook and loop-type fastener in conjunction with two rigid members which have to be placed and positioned prior to bonding.

FIGS. 7 and 8 illustrate an alternative embodiment of the invention, wherein the separation line 66 on the shield 30 has been deleted, permitting reuse of the shield system as, for example, on the carton assembly 70. As there shown, a plurality of fastener strips are secured to the top perimeter surface 74 of a box 70 or the like. The lid or top 76 of the box includes mated strips 78, each covered by a shield 30. The lid 76 may be placed on the box with the adhesive strips 72, 78 in juxtaposition. However, the shield 30 precludes premature attachment and engagement of the hooked and looped surfaces of the strips 72, 78. When the box and lid are properly positioned relative to one another, the tabs 34 may be pulled as shown in FIG. 8, permitting the hooked and looped surfaces of the strip 72 and 78 to engage and bond relative to one another. The box may then later be removed by removing one corner or edge of the lid from the box and tilting the lid outwardly from the box to sequentially disengage the hooked and looped surfaces. The shield 30 may then be placed back over the strips 78 to protect against inadvertent, premature engagement of the fasteners 72, 78 when the lid is again repositioned on the box.

FIGS. 9-12 illustrate an alternative embodiment of the reusable shield as particularly suited for a tensioning belt or the like. As there shown, the belt 80 includes a pair of integral straps 82, 84, each having one of the mated hook and loop pads 86, 88 secured adjacent the outer ends thereof. The shield 30 is disposed between the hooked and looped surfaces of the strips 86, 88, as particularly shown in FIG. 11. In the preferred embodiment, the shield includes the strip 50 which is secured directly to one strap 84 of the belt, with the adhesive strip 88 disposed over the strip 50 and secured directly to the strap 84. The shield 30 is then folded along the line 54, as previously described to define a shield layer 56 which spans and completely covers the surface of the adhesive strip 88. A second fold 58 is provided adjacent to the opposite edge of the strip 88 for defining the flap portion 62 of the shield 30. The flap portion 62 terminates in the tab 34.

With reference to FIGS. 9 and 10, the belt 80 includes a second pair of straps 90, 92 disposed outboard of the first pair of straps 82, 84. In use, the belt may be placed around the waist of the user with straps 82, 84 in place, with the shield 30 protecting against premature engagement of the strips 86, 88. The closure means 94 provided on strap 92 is then adapted for receiving the outer end 96 of the strap 90, whereby the belt may be tightened in position, to the satisfaction of the user. For convenience, hook and loop-type fastener pad 98 may be provided on the surface of strap 90 and a mated hook and loop-type fastener pad 100 may be provided on the outer end 96 of the strap. The outer end 96 may then be secured to the strap 90 by placing the mated surfaces 98, 100 in mated, engaged juxtaposition, as shown in FIG. 10. When the belt is properly positioned and tensioned, the tab 34 may be pulled in the direction of arrow 102, as shown in FIG. 10, for removing the shield layer 56 from interfering relationship with the mated strip surfaces 86, 88, and for permitting the mated surfaces of the strips 86, 88 to come into engagement and bond with one another, as shown in FIG. 12. In the preferred embodiment, the shield layer includes a patch 57 which is a complementary fastener component compatible with the fastener surface of strip 88. This temporarily holds the shield in place during assembly.

While certain features and embodiments of the invention have been described in detail herein, it will be readily understood that the invention encompasses all enhancements and modifications within the spirit and scope of the following claims.

What is claimed is:

1. In a contact fastener such as a hook and loop-type fastener having complementary pads, one pads having a hook fastener surface and the other pad having a mated loop fastener surface, wherein the pads may be secured to one another by placing the pads in mated juxtaposition, with the hook and loop surfaces in contact with one another, and by applying pressure to said pads, an improvement comprising: a removable shield placed over the fastener surface of one of said pads for preventing inadvertent premature engagement of the hook and loop surfaces, and attachment means secured to the shield for releasably attaching the shield to the fastener surface of said one pad.

2. The improvement of claim 1, wherein said shield is an integral part of one of said pads.

3. The improvement of claim 1, further including a pull tab attached to said shield and accessible when said complementary pads are placed in mated juxtaposition, whereby said tab may be pulled and said shield removed to permit engagement of the hooked and looped surfaces.

4. The improvement of claim 3, wherein each of said pads includes opposite side edges defining the boundary of the respective hooked surface and looped surface, and wherein said shield is releasably secured to one of said side edges and spans the pad surface to the opposite side edge, and wherein said pull tab is secured to the shield adjacent said opposite side edge and extends back across said shield and pad surface beyond said one side edge.

5. The improvement of claim 4, further including attachment means for permanently securing the shield to the pad adjacent said one side edge and wherein said shield includes a separation line adjacent to said attachment means, whereby said shield may be separated at the separation line when said tab is pulled.

6. The improvement of claim 5, wherein said separation line comprises a perforation line extending the length of and adjacent to said attachment means.

7. The improvement of claim 1, wherein said shield is made of vinyl.

8. In a contact fastener such as a hook and loop-type fastener assembly having complementary pads, one having a hook surface and the other having a mated loop surface, wherein the pads may be secured to one another by placing the pads in mated juxtaposition, with the hook and loop surfaces in contact with one another, and by applying pressure to said pads, an improvement comprising:

a. a removable shield placed over the surface of one of said pads for preventing inadvertent premature engagement of the hook and loop surfaces;

b. a pull tab attached to the shield and accessible when said complementary pads are placed in juxtaposition with one another, whereby said tab may be pulled and said shield removed from the surface of the pad to facilitate engagement of the hook and loop surfaces;

c. means for releasably securing the shield to said pad; and d. separation means adjacent said attachment means, whereby said shield may be separated and detached from said pad when the pull tab is pulled.

9. The improvement of claim 8, wherein each of said pads includes opposite side edges, and wherein said shield is releasably secured to one of said side edges and spans the surface of the pad to the opposite side edge, and wherein said pull tab is secured to the shield adjacent said opposite side edge and extends back across said shield and the surface of the pad and beyond said one side edge, whereby said tab is operable for pulling the shield back toward the attachment means when said pad surfaces are placed in mated juxtaposition.

10. In a contact fastener such as a hook and loop-type fastener having complementary pads, one having a hook fastener surface and the other having a mated loop fastener surface, wherein the pads may be secured to one another by placing the pads in mated juxtaposition, with the hook and loop surfaces in contact with one another, and by applying pressure to said pads, an improvement comprising:

a. a removable shield placed over the surface of one of said pads for preventing inadvertent, premature engagement of the hook and loop surfaces;

b. means for releasably securing the shield to said pad adjacent said fastener surface; and c. a fastener patch compatible with the fastener surface of the pad for releasably attaching the shield to the pad.

* * * * *